350-174 SR
10/1/85 XR 4,544,258

United States Patent [19]

Takano

[11] Patent Number: 4,544,258

[45] Date of Patent: Oct. 1, 1985

[54] IMAGE DENSITY DETECTING UNIT FOR IMAGE FORMATION APPARATUS

[75] Inventor: Shouji Takano, Kawasaki, Japan

[73] Assignee: Tokyo Shibaura Denki Kabushiki Kaisha, Kawasaki, Japan

[21] Appl. No.: 435,605

[22] Filed: Oct. 20, 1982

[30] Foreign Application Priority Data

Oct. 23, 1981 [JP] Japan ..... 56-157008[U]
Jun. 7, 1982 [JP] Japan ..... 57-97304

[51] Int. Cl.[4] ..... G03G 27/00; G03G 27/34; G03G 27/74; G03G 15/00

[52] U.S. Cl. ..... 355/1; 355/142; 355/38; 355/57; 355/68; 250/216; 250/228; 350/174; 350/630

[58] Field of Search ..... 355/38, 57, 68, 1, 142; 250/216, 227, 228, 572, 211 R, 252; 350/174, 630

[56] References Cited

U.S. PATENT DOCUMENTS 3,217,170 11/1965 Bin-Lun Ho ..... 250/228
3,549,254 12/1970 Muir ..... 355/68
3,914,049 10/1975 Basu et al. ..... 355/68
4,118,622 10/1978 David ..... 250/216
4,200,391 4/1980 Sakamoto et al. ..... 355/68
4,314,283 2/1982 Kramer ..... 250/228

FOREIGN PATENT DOCUMENTS 0021093 1/1981 European Pat. Off. .
0031564 7/1981 European Pat. Off. .
0066187 7/1982 European Pat. Off. .
2605156 4/1976 Fed. Rep. of Germany .
2753632 6/1979 Netherlands .
2040486 8/1980 United Kingdom .

*Primary Examiner*—L. T. Hix
*Assistant Examiner*—Douglas S. Lee
*Attorney, Agent, or Firm*—Cushman, Darby & Cushman

[57] ABSTRACT

The invention provides an image density detecting unit for an image formation apparatus, which is made of a transparent optical medium, which has a reflecting plate whose section is substantially a quadric surface, and which has a focusing unit for focusing, by means of the reflecting plate, light incident on the transparent optical medium at a predetermined position inside the transparent optical medium.

25 Claims, 43 Drawing Figures

IMAGE DENSITY DETECTING UNIT FOR IMAGE FORMATION APPARATUS

BACKGROUND OF THE INVENTION

The present invention relates to an image density detecting unit for an image formation apparatus, which detects the amount of light reflected by a document to obtain a desired copying result in accordance with the detection result.

The quality of an image copied onto a copying paper sheet in an image formation apparatus such as an electronic copying machine has recently been improved. This is because the image carrier (to be referred to as a photosensitive drum hereinafter) and the developer (to be referred to as toner hereinafter) have been improved. Furthermore, an electrical improvement based on studies of the bias voltage for a developing unit has been made. Among the various types of improvements, the automatic exposure unit of an electronic copying machine has received great attention and provides a self-detecting function for adjusting the document density. In principle, the density of the document to be copied can be detected by any detecting method. An image which has a proper density can be obtained in accordance with the above detecting operation in cooperation with an increase or decrease in illuminance (to be referred to as exposure or exposure amount hereinafter), an increase or decrease in the voltage applied to the photosensitive drum, and an increase or decrease in the bias voltage applied to the developing unit. Thus, an optimal copying result may be obtained.

There are two conventional methods for detecting the document density. In one method the exposure is measured at an arbitrary position in the optical path of the optical system for focusing the document image on the surface of the photosensitive drum, to form an electrostatic latent image. In the other method the light-emitting unit for emitting light to the document and the focusing unit for detecting the reflected light are incorporated in addition to the optical system for forming the electrostatic latent image. The former method is realized by the arrangement shown in FIG. 1. Light from a light source 1 is emitted onto a document (not shown) placed between a document table 3 and a document cover 5. Light reflected by the document reaches a photosensitive drum 13 through a reflecting plate 7, a lens 9, and a reflecting plate 11, and an electrostatic latent image is formed on the photosensitive drum 13. The document density is detected by a detecting element 15 which is arranged in the optical path.

However, according to the first system described above, since the detecting element 15 uses part of the optical path, the amount of light which forms the electrostatic image is decreased. Furthermore, although the amount of light which is detected by the detecting element 15 corresponds to the amount of light which forms the image on the photosensitive drum, the amount of light emitted from the light source 1 cannot be spontaneously controlled due to the delay time of the electronic circuit. Since the detecting element 15 is disposed in the optical path of the lens 9, the mounting position of the detecting element 15 greatly affects the precision of measurement of the amount of light.

However, according to the second system described above, as shown in FIG. 2, the apparatus has a lens system 22, an optical path 17 for forming an electrostatic latent image on the surface of the photosensitive drum 13 and an optical path 19 for detecting light reflected by the document. As shown in FIGS. 3A, 4 and 5, focusing units 23, 29, and 31 are respectively disposed in a space 21 of the apparatus. Referring to FIG. 3A, the focusing unit 23 is arranged to converge light from a light-receiving plane 25 to the detecting element 15 utilizing regular and irregular reflection by the reflecting plane. When the focusing unit 23 is arranged in the space 21 of the image formation apparatus, the amount of light emitted from the light source 1 and reflected by the document is insufficient, and proper detection can hardly be performed. As shown in FIG. 3B, the light-receiving plane sensitivity distribution or the light distribution is not uniform, so that the average amount of light incident on the light-receiving plane 25 cannot be detected by the detecting element 15. Referring to FIG. 4, the focusing unit 29 may be made of a self-converging lens (Selfoc lens: trademarks) or an assembly of light-transmitting fibers 33 such as optical fibers. Detecting elements 37 and 39 are respectively mounted on the light-converging plane which is opposite to a light-receiving plane 35. However, in the focusing unit of this type, since the area of the light-receiving plane 35 is the same as that of the light-converging plane, the area of the detecting element must be increased, or a plurality of detecting elements must be used, resulting in a high cost. Furthermore, the focusing unit which comprises an assembly of converging light transmitting fibers is expensive. Referring to FIG. 5, the focusing unit 31 is made of an assembly of optical fibers and has a light-receiving plane 41 whose section has a different shape from that of a detecting plane 43. Even if a low-cost optical fiber is used, the shape of the outer structure is complex, which prevents mass production and results in high cost. Furthermore, since the light-receiving plane 41 is wide and the optical fibers must be concentrated at a single point to form the detecting plane 43, the focusing unit becomes large in size because the optical fiber has a maximum allowable curvature.

As described above, the focusing units for detecting the document density have both economic and performance problems. This is especially so in the case of the focusing unit 23 as shown in FIG. 3A, where a sufficient amount of light cannot be obtained and the light-receiving plane sensitivity distribution becomes nonuniform as shown in FIG. 3B. As a result, a proper density of the document cannot be detected.

SUMMARY OF THE INVENTION

The present invention has been made in consideration of the above situations and has for its object to provide a compact, low-cost and highly reliable image density detecting unit of a simple construction for an image formation apparatus, wherein light reflected by a document is efficiently converged to control a controlling means which maximizes the electrostatic contrast of the image carrier, whereby an image of high quality is obtained.

In order to achieve the above object of the present invention, there is provided an image density detecting unit which is used for an image formation apparatus for forming an electrostatic image on an image carrier by projecting an image of a document and which has a detecting means for detecting the amount of light reflected by the document, characterized in that the detecting means comprises a focusing unit which is constituted by a transparent optical medium and which has a light-receiving plane and a reflecting plane of a reflecting plate having a quadratic surface in order to converge incident light in the transparent optical medium within a predetermined range by means of the reflecting plate.

BRIEF DESCRIPTION OF THE DRAWINGS

Other objects and features of the present invention will be apparent from the following description taken in connection with the accompanying drawings, in which.

DETAILED DESCRIPTION OF THE PREFERRED EMBODIMENTS

An embodiment of the present invention will be described in detail with reference to the accompanying drawings.

Figure 1:
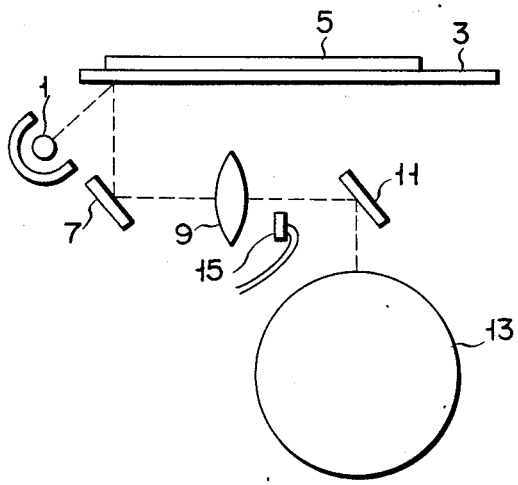
FIG. 1 (PRIOR ART)
FIG. 1 is a view for explaining a conventional image density detecting method in which the amount of light is detected at an arbitrary position in the optical path.
Figure 2:
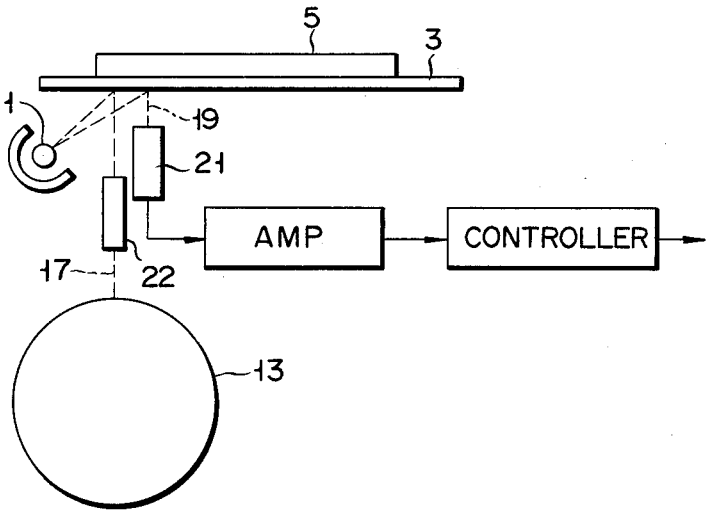
FIG. 2 (PRIOR ART)
FIG. 2 is a view for explaining a conventional image density detecting method in which the focusing unit is adopted to detect the light emitted to the document and the light reflected therefrom, and which is separate from the optical system for forming an electrostatic image.
Figure 3A:
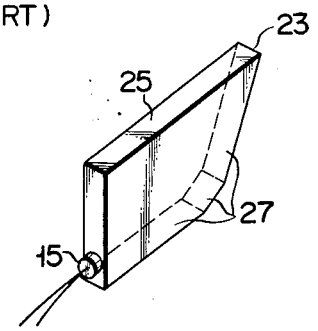
FIG. 3A (PRIOR ART)
FIG. 3A is a schematic perspective view of a conventional focusing unit.
Figure 3B:
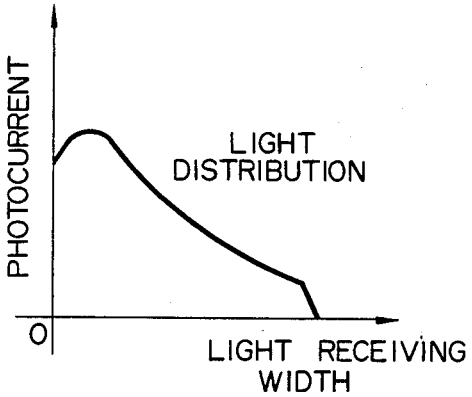
FIG. 3B (PRIOR ART)
FIG. 3B is a graph showing the photocurrent as a function of the light-receiving width to explain the light-receiving plane sensitivity distribution of the focusing unit shown in FIG. 3A.
Figure 4:
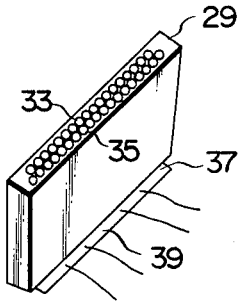
FIG. 4 (PRIOR ART)
FIG. 4 is a schematic perspective view of another type of conventional focusing unit.
Figure 5:
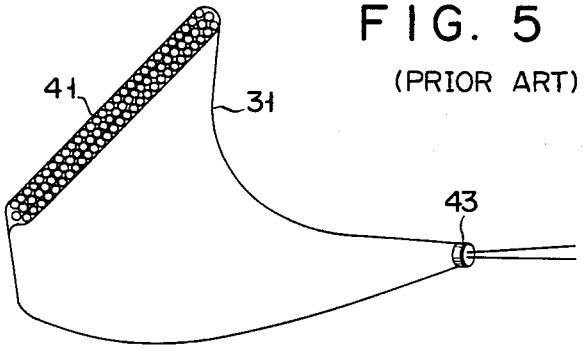
FIG. 5 (PRIOR ART)
FIG. 5 is a schematic perspective view of still another type of conventional focusing unit.
Figure 6:
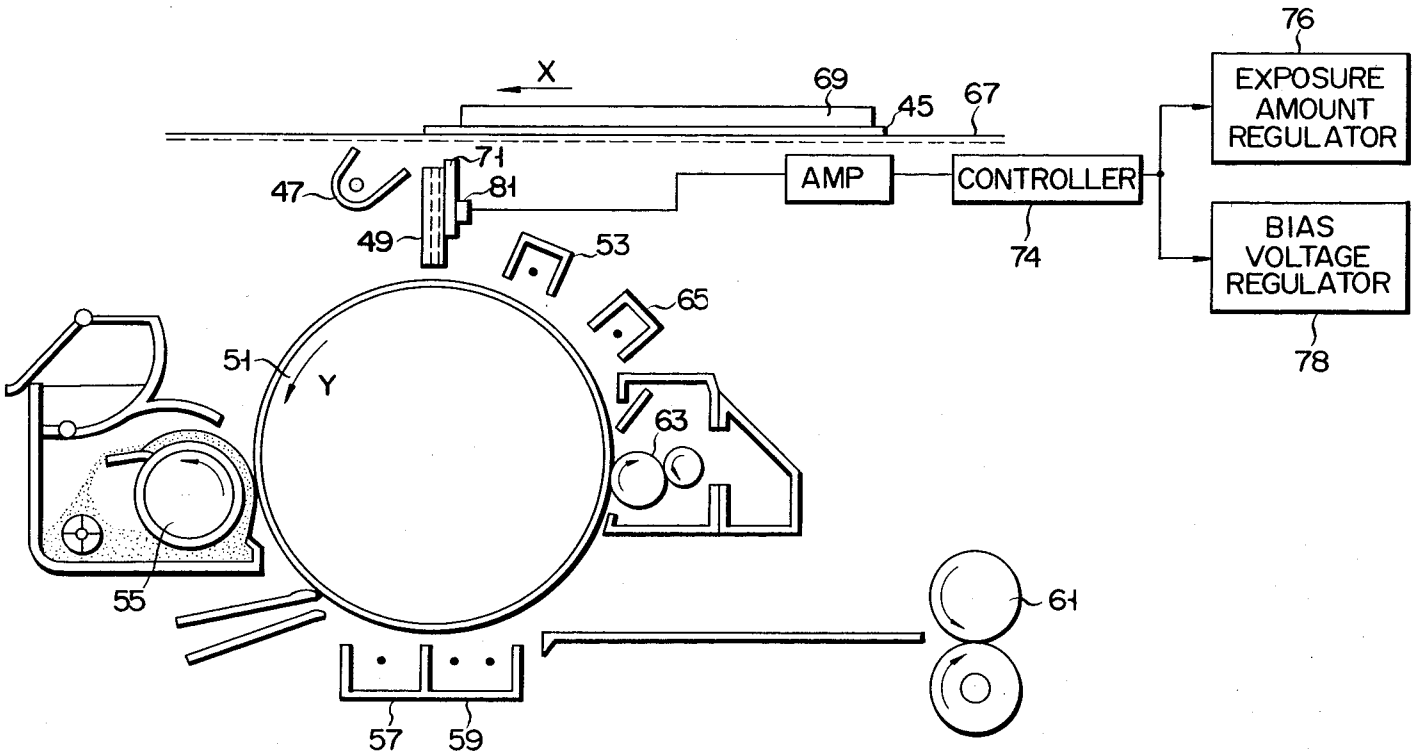
FIG. 6 is a schematic view of an electronic copying machine to which the image density detecting unit of the present invention is applied.
Figure 7:
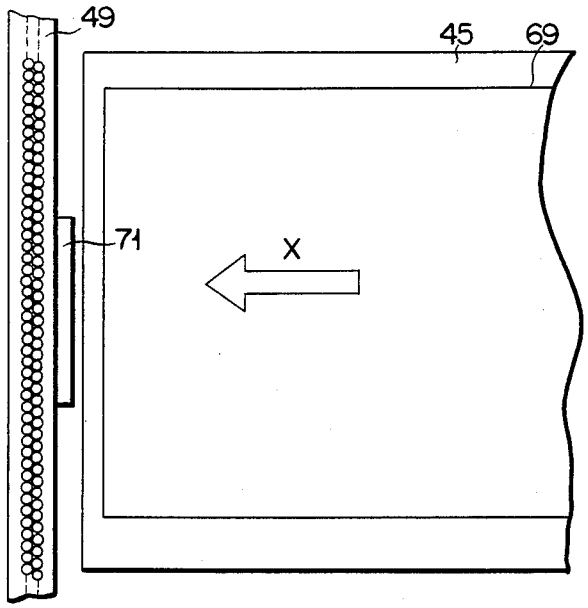
FIG. 7 is a partial schematic plan view of part of the electronic copying machine shown in FIG. 6.
Figure 8:
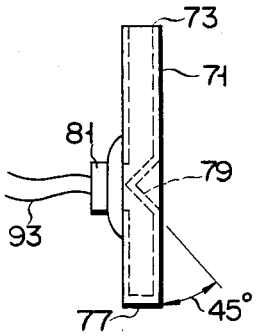
FIG. 8 is a front view of an image density detecting unit according to an embodiment of the present invention.

FIG. 6 is a schematic view of an electronic copying machine to which an image density detecting unit of the present invention is applied, and FIG. 7 is a plan view thereof. A document is placed on a document table 45 which is moved in the direction indicated by arrow X as needed. When the document table 45 is moved, the document thereon passes along a light source (exposure lamp) 47, so that the document is illuminated by light from the exposure lamp 47. Light reflected by the document reaches a photosensitive drum 51 through a converging light-transmitting body 49. An image of the document (to be copied) is formed on the surface of the photosensitive drum 51. The photosensitive drum 51 is rotated in the direction indicated by arrow Y. The photosensitive drum 51 is first charged by a charger 53, and the image of the document is exposed, so that an electrostatic latent image is formed on the surface of the photosensitive drum 51. The electrostatic latent image is visualized when the developer is attached thereto by a developing unit 55. Meanwhile, a copying paper sheet stored in a storage unit such as a cassette (not shown) is fed out of the cassette by a pickup roller synchronously operative with rotation of the photosensitive drum 51 and is conveyed by rollers (not shown). The copying paper sheet thus conveyed is brought into tight contact with the surface of the photosensitive drum 51 at a transfer charger 57. The electrostatic latent image on the photosensitive drum 51 is transferred onto the copying paper sheet by the transfer charger 57. The copying paper sheet to which the image is transferred is separated from the photosensitive drum 51 by a discharger 59 and is conveyed to a fixing unit 61. Thus, the transferred image is fixed by heat. The copying paper sheet is then fed out from the delivery port through delivery rollers (not shown). Meanwhile, after the electrostatic latent image is transferred from the photosensitive drum 51 to the copying paper sheet, the photosensitive drum is cleaned by a cleaning brush 63 and is discharged by a discharger 65. Thus, the photosensitive drum is reset in the initial state.

The optical system using the converging light-transmitting body 49 will be described in detail. The document is placed face down on the document table 45 which reciprocates right-to-left or left-to-right in FIG. 6 and is held by a document holder 69 which is integral with the document table 45. Upon rotation of the photosensitive drum 51, the document table 45 is moved to the left (direction indicated by arrow X) at the same speed as that of the photosensitive drum 51. Simultaneously when the document table 45 starts moving to the left, the exposure lamp 47 is turned on. Thus, the document on the document table 45 is illuminated by light from the exposure lamp 47. Light reflected by the document is transmitted to the photosensitive drum 51 through the converging light-transmitting body shown in FIG. 6. Thus, the electrostatic latent image is formed on the photosensitive drum 51. The converging light-transmitting body 49 may comprise a self-converging fiber lens (Selfoc lens: trademarks). As shown in FIG. 7, an image density detecting/focusing unit 71 to measure the amount of light reflected by the document is arranged parallel to the converging light-transmitting body 49 and before the converging light-transmitting body 49 with respect to the moving direction (direction indicated by arrow X) of the document table 45.

Figure 9:
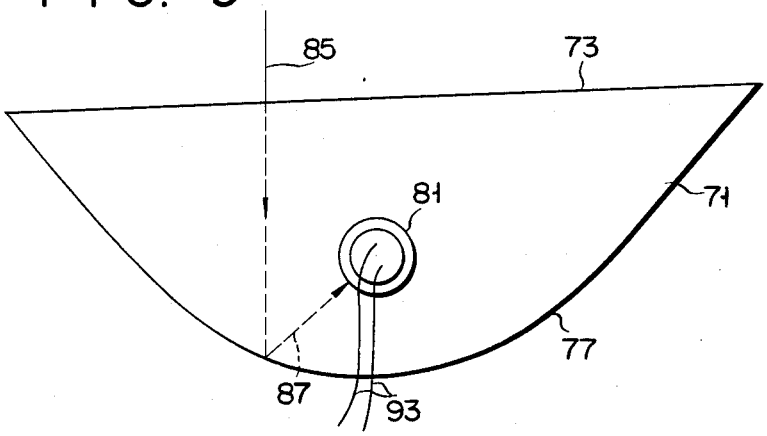
FIG. 9 is a left side view of the image density detecting unit shown in FIG. 8.
Figure 10:
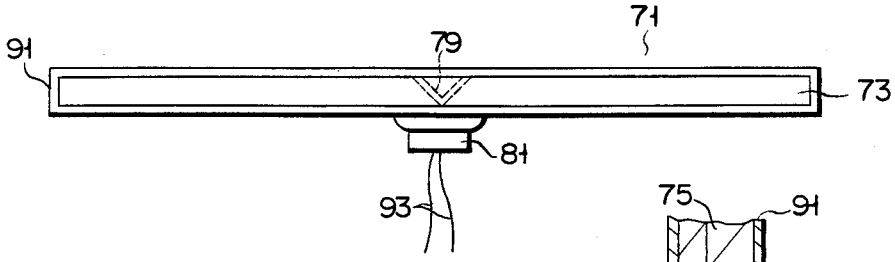
FIG. 10 is a plan view of the image density detecting unit shown in FIG. 8.
Figure 11:
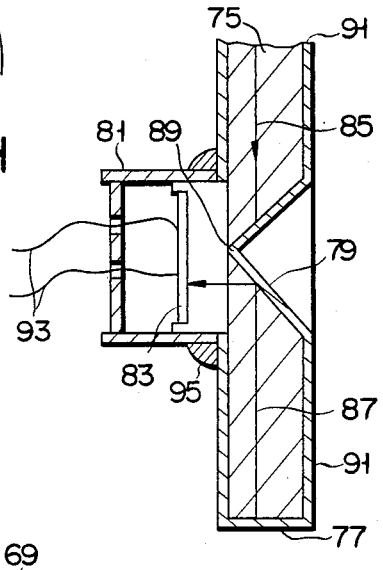
FIG. 11 is an enlarged sectional view showing the main part of the image density detecting unit shown in FIG. 8.

The arrangement of the focusing unit 71 is shown in FIGS. 8 to 11. The light reflected by the document is incident on a light-receiving plane 73 and passes through a transparent optical medium 75. The light-receiving width of focusing unit 71 is equal to or smaller than a minimum document width for the electronic copying machine. The light is then reflected by a first reflecting plate 77 of the quadric surface and is reflected by a second reflecting plate of a conical surface. The reflected light passes through a transparent focus window 89 and is incident on a photocell 83 of a light detecting element 81. Referring to FIGS. 9 and 11, reference numerals 85 and 87 denote an incident light optical path and a reflected light optical path, respectively. The transparent optical medium 75 comprises the incident light plane 73, the first reflecting plate 77 and the second reflecting plate 79 whose opposing surfaces form an angle of 45°. The surface of the transparent optical medium 75 is coated with a reflecting film 91 except for the incident light plane 73 and the transparent focus window 89. The light detecting element 81 which has lead wires 93 is adhered to the transparent focus window 89 by a proper means such as an adhesive 95. As a result, light from the incident light plane 73 can be effectively converged. In the above embodiment, the first reflecting plate 77 comprises a quadric surface, while the second reflecting plate 79 comprises a conical surface. However, the present invention is not limited to this. The first reflecting plate 77 may comprise any surface which can form a focal point. Similarly, the second reflecting plate 77 may comprise any surface which transmits the light converged by the first reflecting plate to the light-receiving surface of the light detecting element 81.

Since the first and second reflecting plates 77 and 79 can converge light rays, the light-receiving plane of the light detecting element 81 may have any shape. Furthermore, since the first and second reflecting plates 77 and 79 are disposed respectively on the outside and inside of the transparent light-transmitting body, the unit becomes small in size as a whole, and the configuration of the reflecting planes may be simplified, resulting in low cost.

Practical examples of the above embodiment and modifications of a focusing unit (to be referred to as a focus path hereinafter) of the image density detecting-/focusing unit will be described in detail below.

PRACTICAL EXAMPLE 1

Figure 12:
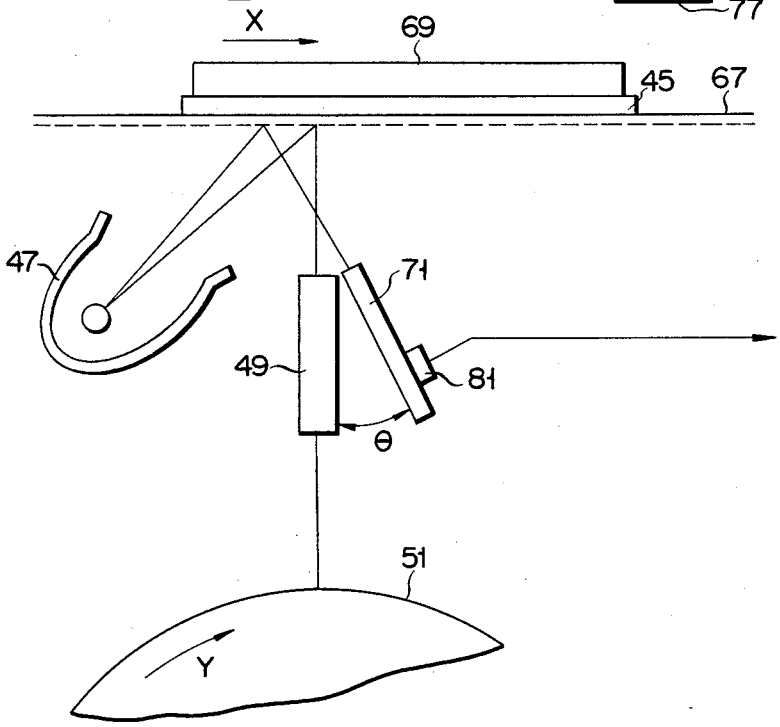
FIG. 12 is a schematic view showing a modification of the electronic copying machine shown in FIG. 6.
Figure 13:
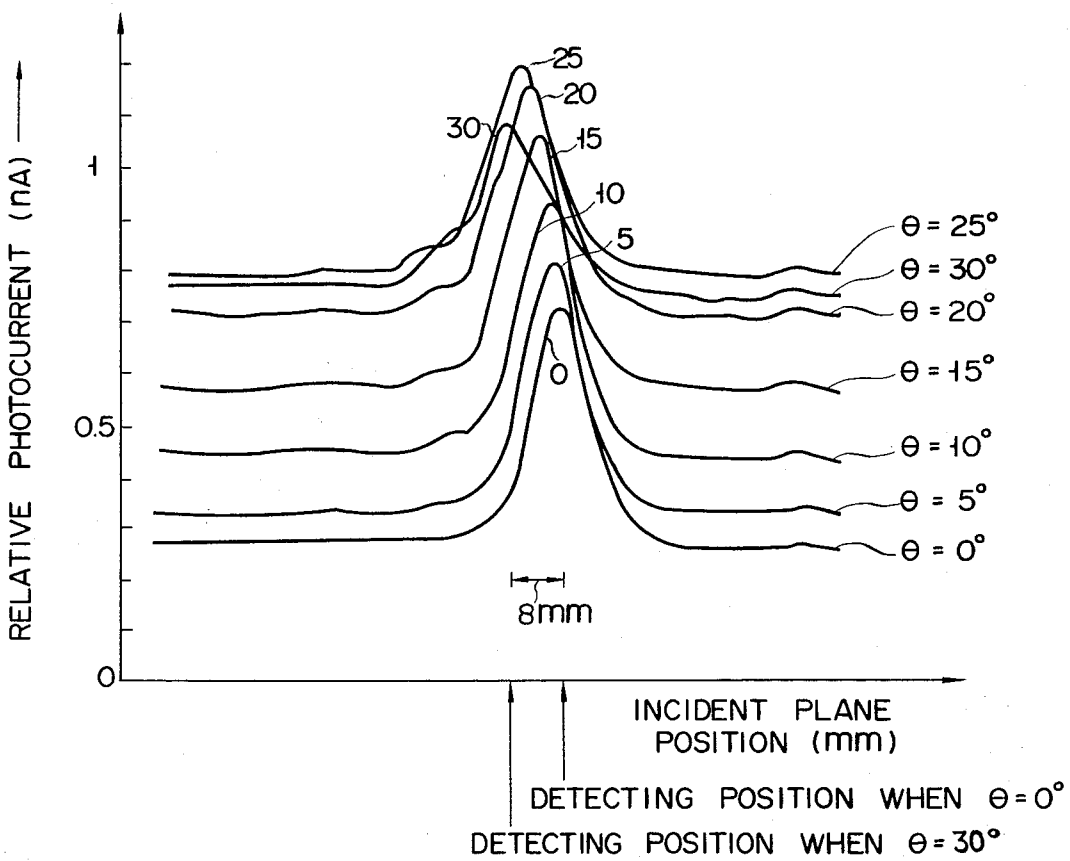
FIG. 13 is a graph showing the relative photocurrent as a function of the incident (or light-receiving) plane position when the angle $\theta$ between the converging light-transmitting body and the focusing unit for detecting the image density is changed.

FIG. 12 is a schematic view of part of an electronic copying machine in which the document table 45 is moved in the direction indicated by arrow X opposite to the direction of arrow X in FIG. 6 and the photosensitive drum 51 is rotated in the direction indicated by arrow Y opposite to the direction of arrow Y in FIG. 6 while an electrostatic latent image is formed on the photosensitive drum 51. Reference symbol $\theta$ denotes an angle between the converging light-transmitting body 49 and the image density detecting/focusing unit 71. If the angle $\theta$ is zero, the focusing unit 71 cannot detect image information of the document prior to the converging light-transmitting body 49. However, when the angle $\theta$ is greater than a predetermined value, the focusing unit 71 can detect the image information prior to the converging light-transmitting body 49. FIG. 13 shows the relationship between the angle $\theta$ and the detecting position. When the angle $\theta$ is 30°, the focusing unit 71 detects a position 8 mm ahead of the detecting position when the angle $\theta$ is zero. Furthermore, in Practical Example 2 to be described later, in which a lens is arranged to form an electrostatic latent image on the photosensitive drum shown in FIG. 14, the focusing unit 71 is tilted at an arbitrary angle to obtain the same effect.

As described above, by tilting the focusing unit, the image density of the document can be detected prior to the current electrostatic latent image.

PRACTICAL EXAMPLE 2

Figure 14:
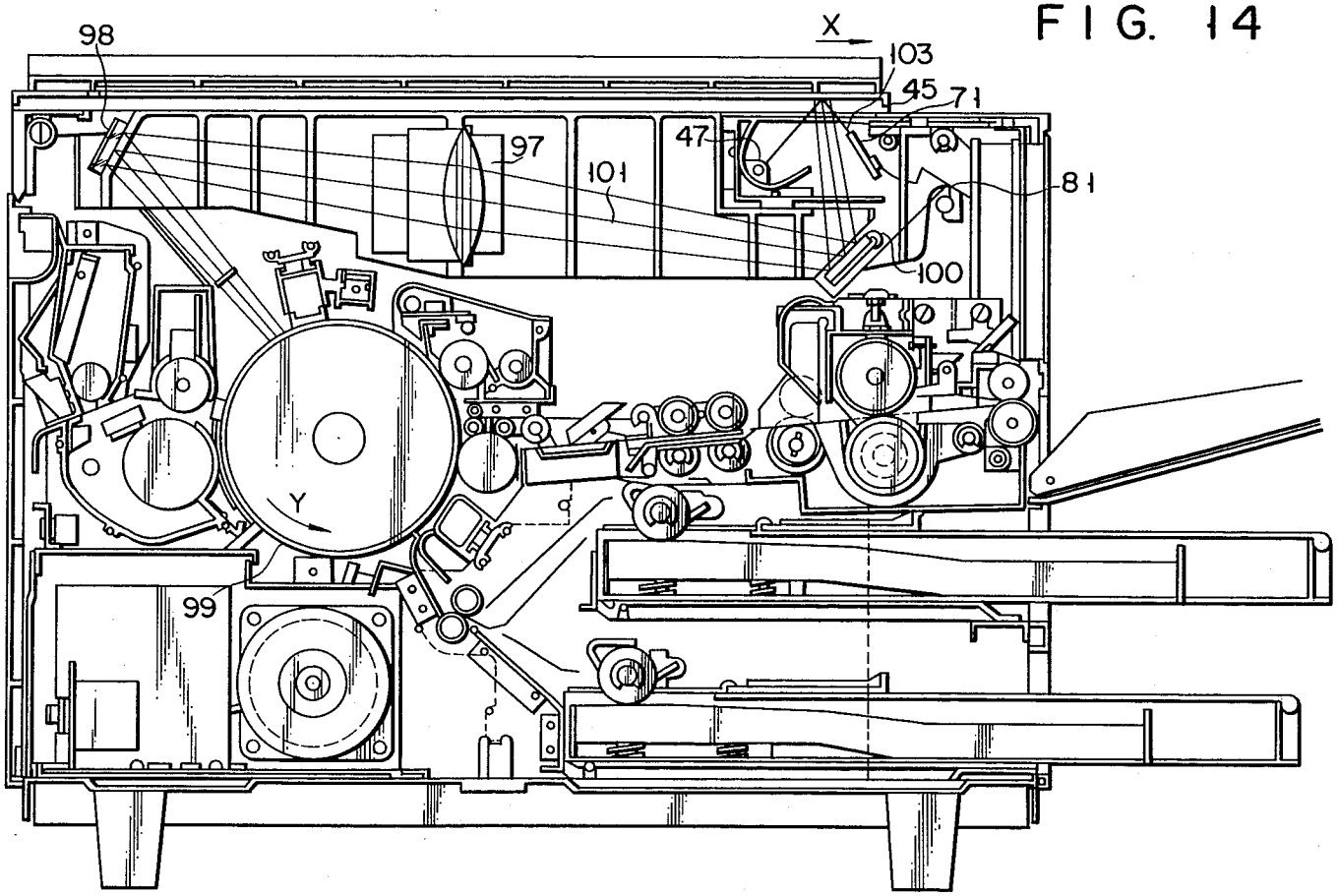
FIG. 14 is a schematic view of an electronic copying machine to which the image density detecting unit shown in FIG. 13 is applied.
Figure 15:
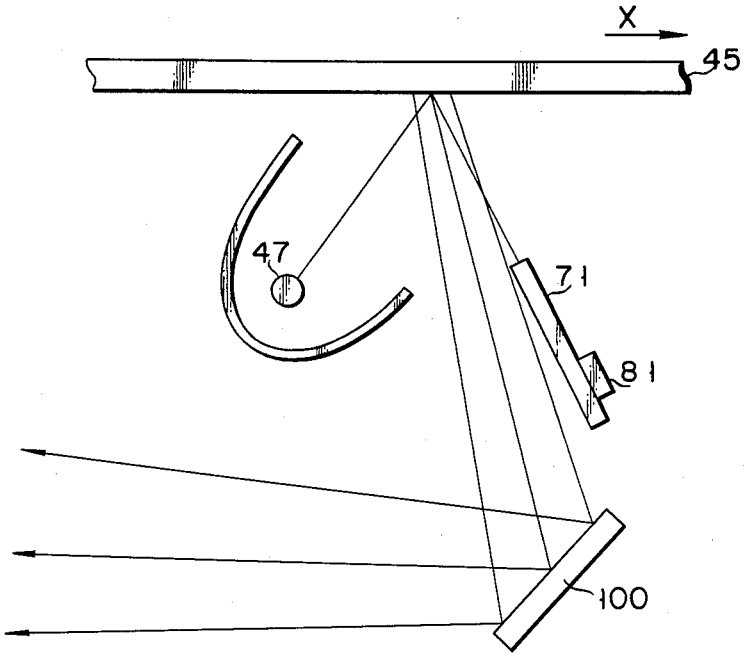
FIG. 15 is an enlarged view showing the main part of the electronic copying machine shown in FIG. 14.

FIG. 14 is a schematic view of an electronic copying machine to which the image density detecting/focusing unit is applied in order to form an electrostatic latent image on a photosensitive drum 99 by transmitting the reflected light through a lens 97. FIG. 15 is an enlarged view of the image density detecting/focusing unit shown in FIG. 14.

Referring to FIG. 14, reference numeral 101 denotes an optical path for forming an electrostatic latent image on the photosensitive drum 99; and 103, an optical path for detecting the image density of the document by means of the focusing unit 71. Light along the optical path 101 passes through a first mirror 100, a lens 97 and a second mirror 98 and reaches the photosensitive drum 99 to form the electrostatic latent image thereon. At this time, the exposure lamp 47 illuminates the document table 45 which is moved in the direction indicated by arrow X. A complete image of the document is exposed. The,focusing unit 71 detects an image prior to the currently formed latent image on the photosensitive drum 99.

In the above example, an electronic copying machine is used which has a movable document table. However, an electronic copying machine having a stationary document table provides the same effect. In this case, the focusing unit 71 is mounted on a table (not shown) of a movable exposure lamp 47 and a movable reflecting plate or reflector. When the focusing unit 71 is tilted as shown in FIG. 14, an image prior to the current electrostatic latent image on the photosensitive drum 99 can be detected.

According to Practical Examples 1 and 2, since the focusing unit 71 is tilted, delay time with respect to the detection of the image density of the document and the formation of the electrostatic latent image formed on the surface of the photosensitive drum is eliminated from the automatic exposure control unit.

Modifications of the focusing unit 71 will be described below.

Modification 1

Figure 16:
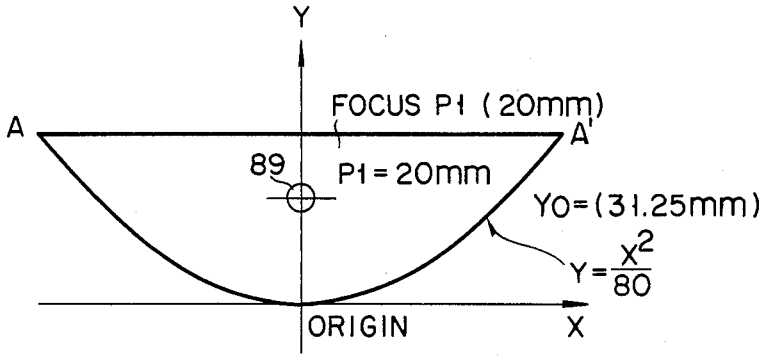
FIG. 16 is a side view of an example of an image density detecting unit made of a transparent resin.

FIG. 16 shows the light-receiving plane sensitivity distribution of the image density detecting/focusing unit which is made of a transparent resin. Referring to FIG. 16, the sensitivity distribution of the light-receiving plane A - A' which is plotted along the X-axis is determined by the shape of the focusing plate and the refractive index of the material thereof. The distribution is shown in FIG. 17.

Figure 17:
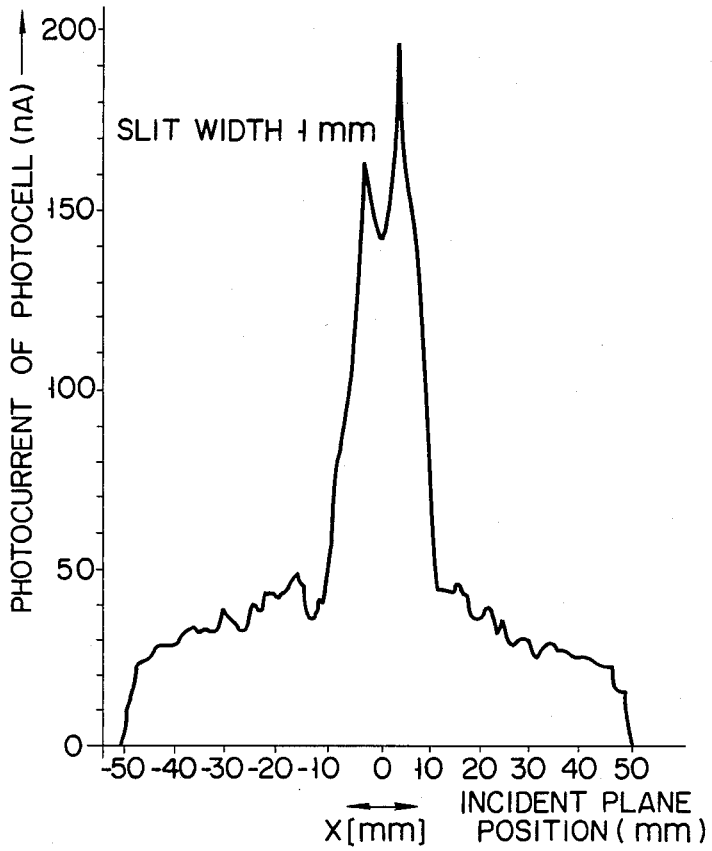
FIG. 17 is a graph showing the photocurrent of the photocell as a function of the incident plane position to explain the light-receiving plane sensitivity distribution of the image density detecting unit shown in FIG. 16.

Referring to FIG. 17, a peak width x' for x=0 is determined by the refractive index n, the position P1 of the focus point, and the height y0 as follows:

$$x' = \pm(y0 - P1)\tan\{\sin^{-1}(1/n)\}$$

For example, for y0=31.25 mm, P1=20 mm and n=1.49, the peak width x' is about±10.18 mm.

Figure 18:
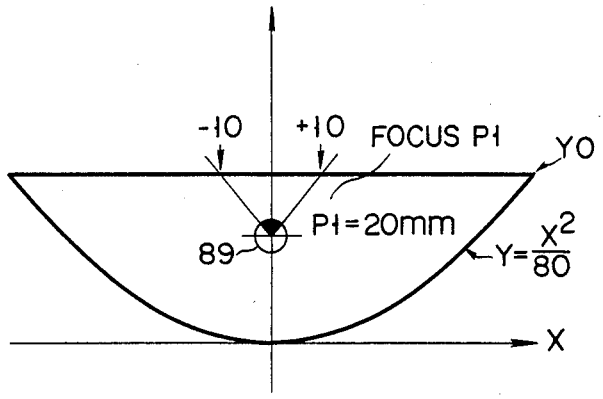
FIG. 18 is a side view showing an example of an image density detecting unit which has a mask to cut light rays having a width x'.
Figure 19:
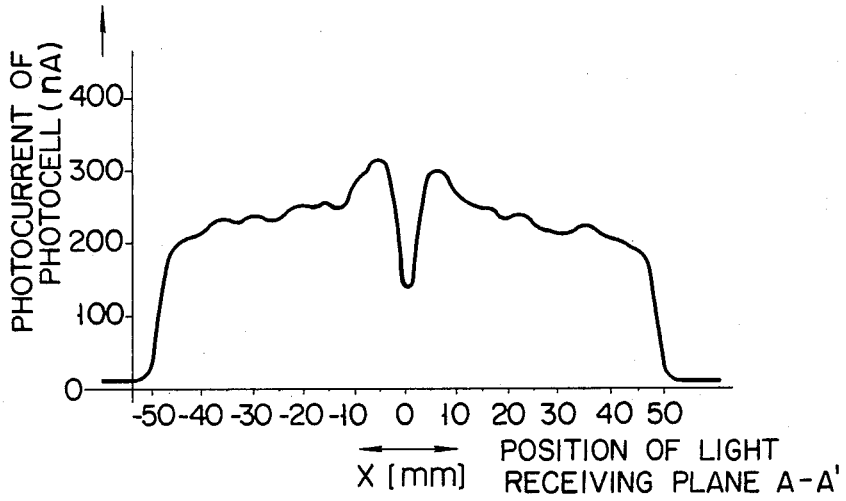
FIG. 19 is a graph showing the photocurrent of the photocell as a function of the position of the light-receiving plane to explain the light-receiving-plane sensitivity distribution of the image density detecting unit shown in FIG. 18.
Figure 20A:
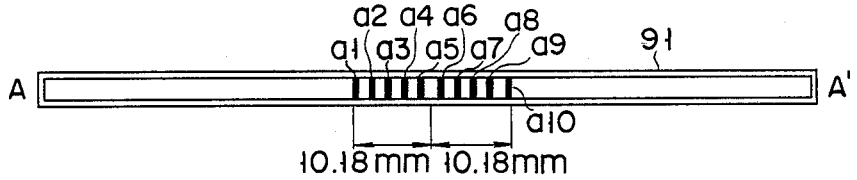
FIGS. 20A and 20B are respectively a plan view and a side view of an image density detecting unit which has a slit.
Figure 20B:
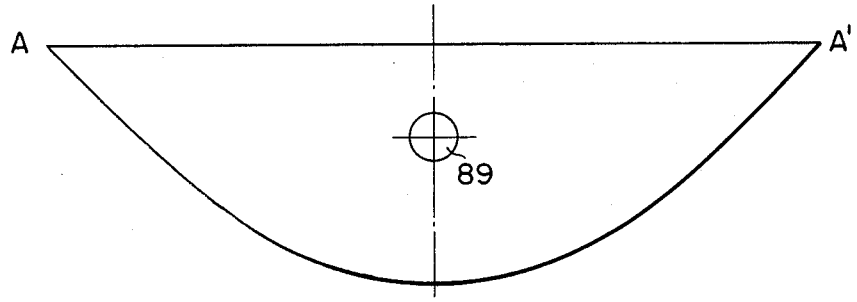
Figure 21:
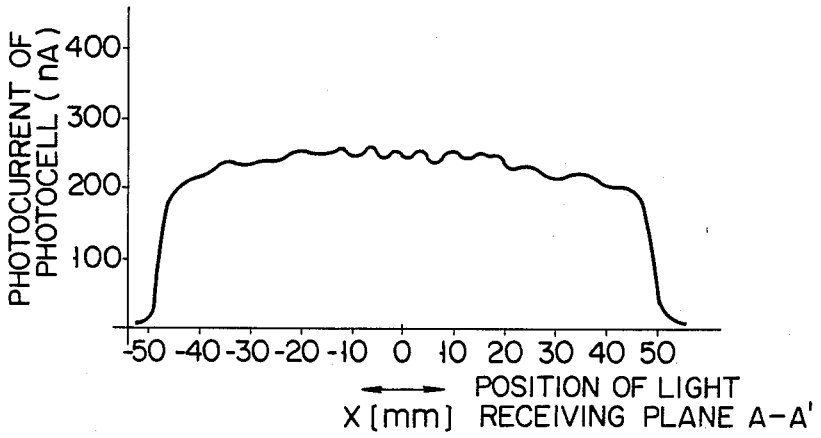
FIG. 21, is a graph showing the photocurrent of the photocell as a function of the position of the light-receiving plane to explain the light-receiving-plane sensitivity distribution of the image density detecting unit shown in FIG. 20.

A mask for cutting light rays having the peak width x' is shown in FIG. 18. FIG. 19 shows the light-receiving plane sensitivity distribution of the unit shown in FIG. 18. FIGS. 20A and 20B show a unit which has a slit-shaped mask within the peak width x' of the light-receiving plane A - A' so as to obtain the uniform light-receiving plane sensitivity distribution as shown in FIG. 21.

FIGS. 16, 18, 20A and 20B show the focusing unit 71 shown in FIGS. 8, 9, 10 and 11, using the X-Y coordinates. FIGS. 17, 19 and 21 respectively show the photocurrent of the photocell as a function of light-receiving plane sensitivity distributions of the focusing units shown in FIG. 16, 18, and 20A and 20B.

The mask at the transparent focus window 89 shown in FIG. 18 and slits a1 to a10 on the incident light or light-receiving plane A - A' shown in FIG. 20 may be disposed in a region corresponding to the peak width x' of the light-receiving plane sensitivity distribution calculated by using the constants y0, P1 and n. Thus, a substantially uniform light-receiving plane sensitivity distribution can be obtained.

Even if a calculated peak width x' is covered with a semi-transparent material, the same effect obtained with the above means can be obtained. Alternatively, a region corresponding to the peak width x' of the light-receiving plane sensitivity distribution on the conical reflecting plane (second reflecting plate 79) is formed by a nonconical reflecting plane to obtain the same effect.

It is found experimentally and theoretically that a relatively uniform light-receiving plane sensitivity distribution can be obtained when P1/y0 is within 0.5 to 1.0 for n=1.5.

When the light-receiving plane sensitivity distribution is uniform, a uniform image density of the document can be detected.

Modification 2

The reflecting film 91 shown in FIG. 20A has an aluminum deposition film 102 (FIG. 22) thereon. Other coatings such as a white coating may also be utilized.

Figure 22:
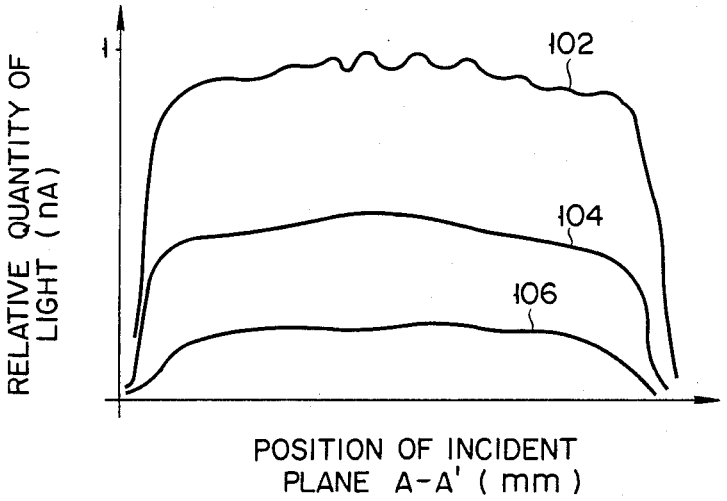
FIG. 22 is a graph showing the relative quantity or amount of light as a function of the position of the incident plane to explain the light-receiving plane sensitivity distribution of a focusing plate for detecting the image density when aluminum is deposited on the plate, and white and silver paints respectively are coated on the plate.

FIG. 22 shows light-receiving surface sensitivity distributions of the focusing unit 71 which respectively have an aluminum deposition film 102, a white coating 104 and a silver coating 106.

By properly selecting a material for the reflecting film 91, an increase or decrease in the amount of light converged by the same focusing unit can be adjusted. Furthermore, a reflecting film such as the white coating and the silver coating can eliminate disturbance of the light-receiving plane sensitivity distribution as compared with the aluminum deposition film which is a completely mirrored surface.

Modification 3

Figure 23A:
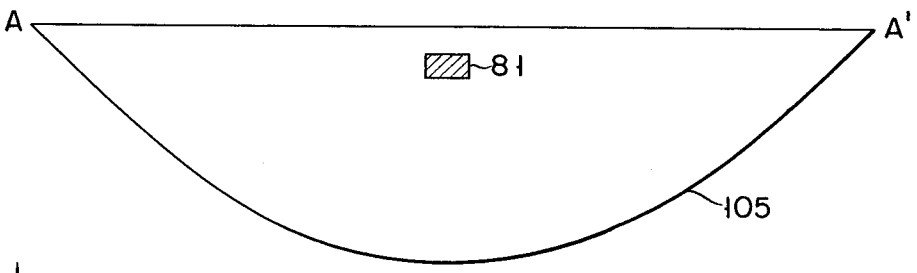
FIGS. 23A and 23B respectively a side view and a front view of a modification of an image density detecting unit in which a light-receiving element is embedded at the focal point of the focusing plate made of a transparent material.
Figure 23B:
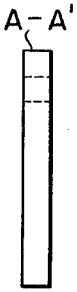
Figure 23C:
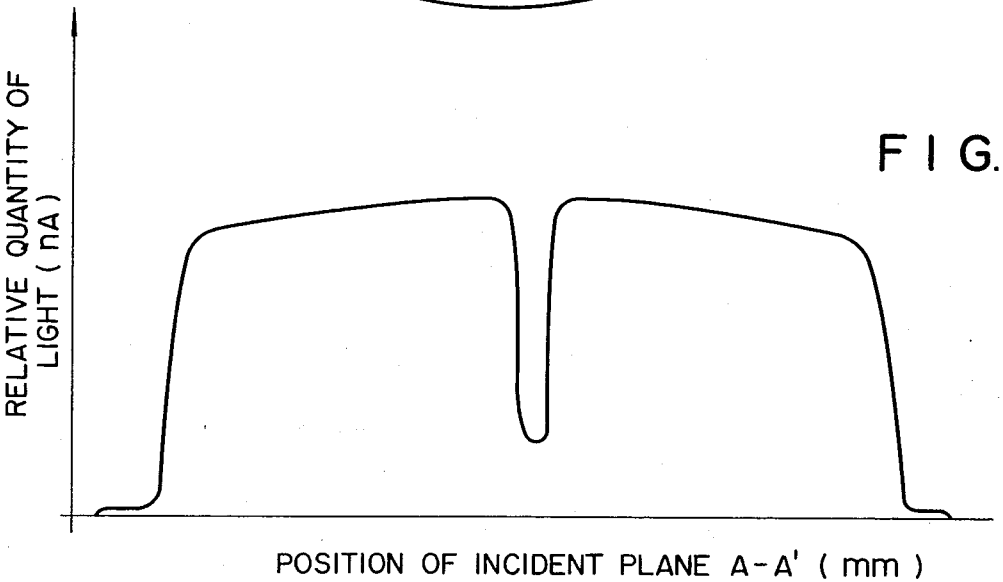
FIG. 23C is a graph showing the relative quantity of light as a function of the position of the incident or light-receiving plane to explain the light-receiving distribution of the image density detecting unit shown in FIG. 23A.

FIGS. 23A and 23B show a case in which a light-receiving element 81 is embedded at the focal point of the focusing unit made of a transparent material, FIG. 23A being a side view thereof, and FIG. 23B a front view thereof. FIG. 23C shows the light-receiving plane sensitivity distribution of the focusing unit or plate shown in FIG. 23A.

The light-receiving plane opposes a quadratic surface 105 and is formed at the focal point to obtain the light-receiving plane sensitivity distribution shown in FIG. 23C. According to this distribution, the light-receiving sensitivity is lowered at the center of the incident light or light-receiving plane A - A'. However, the light-receiving sensitivities at each side of the incident light plane A - A' become substantially uniform. The light-receiving plane of the embedded photocell is not limited to a flat surface. For example, a cylindrical, spherical, or polygonal surface may be utilized to arbitrarily adjust the light-receiving plane sensitivity distribution.

Modification 4

Figure 24A:
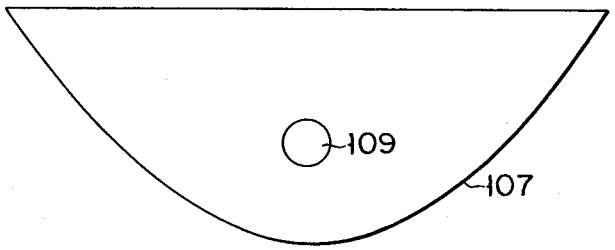
FIGS. 24A and 24B are respectively a side view and a sectional view showing another modification of the image density detecting unit.
Figure 24B:
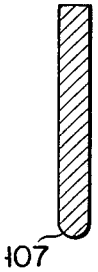

FIG. 24A is a side view of a modification showing a focusing unit which has a focal point 109 in a quadric surface 107, and FIG. 24B is a sectional view thereof.

Referring to FIG. 24A, a curve of the section of the quadric surface 107 is so determined as to converge light to the focal point 109. In this manner, since the light is converged to the focal point 109 by the quadric surface 107, an effective focusing operation can be further accomplished.

Furthermore, even if the focal point 109 does not correspond to the focal point of the quadric surface 107, substantially the same effect can be obtained.

Modification 5

Figure 25:
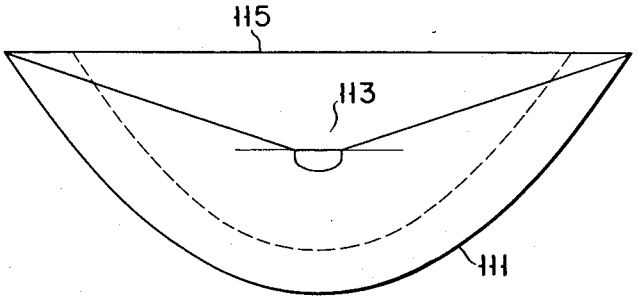
FIGS. 25, 26, 27A and 27B are perspective views showing still another modification of the image density detecting unit.
Figure 26:
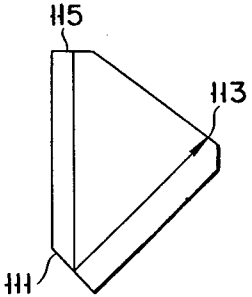
Figure 27A:
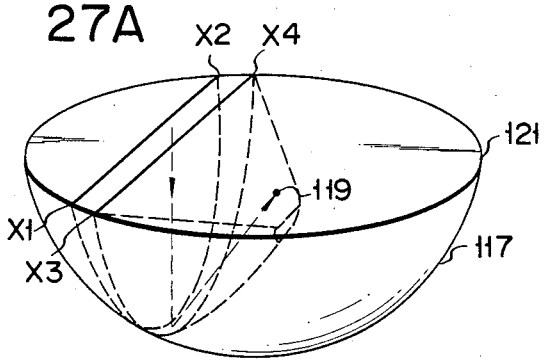
Figure 27B:
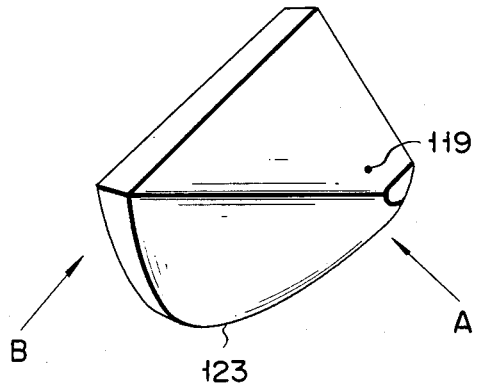

Referring to FIGS. 25 and 26, a quadric surface 111 is defined as a reflecting plane, and light incident on a light-receiving plane 115 is converged to a focal point 113 of the quadric surface 111. FIG. 27A shows a plane 117 of revolution (e.g., a paraboloid of revolution). FIG. 27B shows a focusing plate obtained from a hemispherical body 121 which has a focal point 119 and a plane X1-X2-X3-X4. FIG. 25 shows the focusing plate viewed from the direction indicated by arrow A, and FIG. 26 shows the focusing plate viewed from the direction indicated by arrow B.

When the focal point 119 of the plane 117 of revolution shown in FIG. 27A corresponds to the focal point 113 shown in FIGS. 25 and 26, the reflecting plane for converging the light comprises only the quadric surface 111. Thus, the light is focused onto a photocell mounted at the focal point 113.

In this case, no obstacle is present in the optical path to block the light rays from the light-receiving or incident light plane X1-X2-X3-X4. A more uniform light-receiving plane sensitivity distribution than that obtained in the focusing unit shown in FIGS. 8 to 11 can be obtained. Furthermore, since the focusing unit or plate shown in FIGS. 25 and 27 has a small focusing area at the focal point 113, a photocell which has a small light-receiving area can be used.

Modification 6

Figure 28:
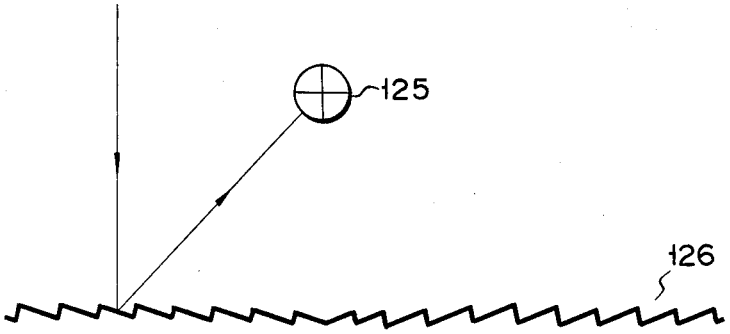
FIG. 28 is a view for explaining the main part of the image density detecting unit shown in FIGS. 25 to 27.

FIG. 28 shows a case in which the first reflecting plate comprises a noncontinuous reflecting plane 126 and the second reflecting plate or photocell is disposed at a focal point 125 of the first reflecting plate. When the second reflecting plate is disposed at the focal point 125, the amount of light is detected by the photocell after the light incident on the second reflecting plate is reflected and guided to the photocell. However, when the photocell is disposed directly at the focal point of the first reflecting plate, an output from the photocell determines the amount of light.

In this manner, if the first reflecting plate comprises a noncontinuous plane, discontinuity is utilized to adjust the light-receiving plane sensitivity distribution.

Modification 7

Figure 29A:
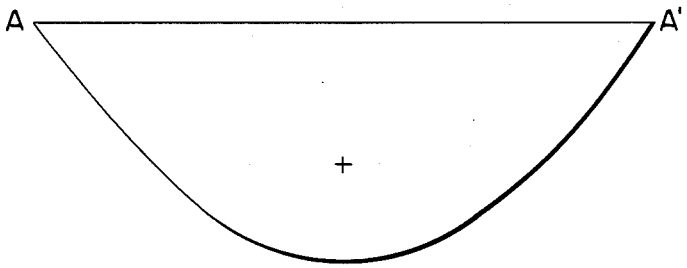
FIGS. 29A and 29B are respectively a side view and a front view of a projector to which the focusing unit is applied.
Figure 29B:
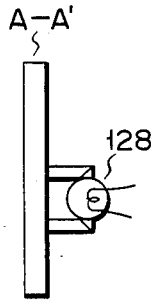

FIGS. 29A and 29B show an example of a focusing unit which is used as a projector. Light from a light source 128 (e.g., a light-emitting diode or light bulb) is reflected by a second reflecting plate and scattered over a first reflecting plate. The scattered light rays are reflected by the light-receiving or incident light plane A - A'. The light source 128 is disposed at a focal point of the focusing unit shown in FIG. 18, 20, 23, 24A and 24B, 25, or 28, and the focusing unit can be used as a projector.

Light-emitting display and the discharge effect of the photosensitive drum of the electronic copying machine are typical examples of using the focusing unit as a projector.

In Modification 7, a light point source (e.g., a light-emitting diode or light bulb) is converted to a plane light source, and the focusing unit can be used as a projector for illuminating a predetermined area. A control operation after image density detection is performed will now be described.

The detection signal from the light detecting element is supplied to an amplifier circuit through the lead wires. A controller 74 is controlled by an output from the amplifier circuit. For example, when an exposure adjusting circuit is controlled to change the amount of light emitted from the light source, a proper exposure or exposure amount is obtained when the document passes along the optical fiber assembly to form an image. An output from the controller 74 is supplied to a bias voltage regulator 78 to regulate the bias voltage. The controller 74 is arranged to control at least one of the exposures (for maximizing the electrostatic contrast of the photosensitive drum) and the bias voltage (for developing the image).

Figure 30:
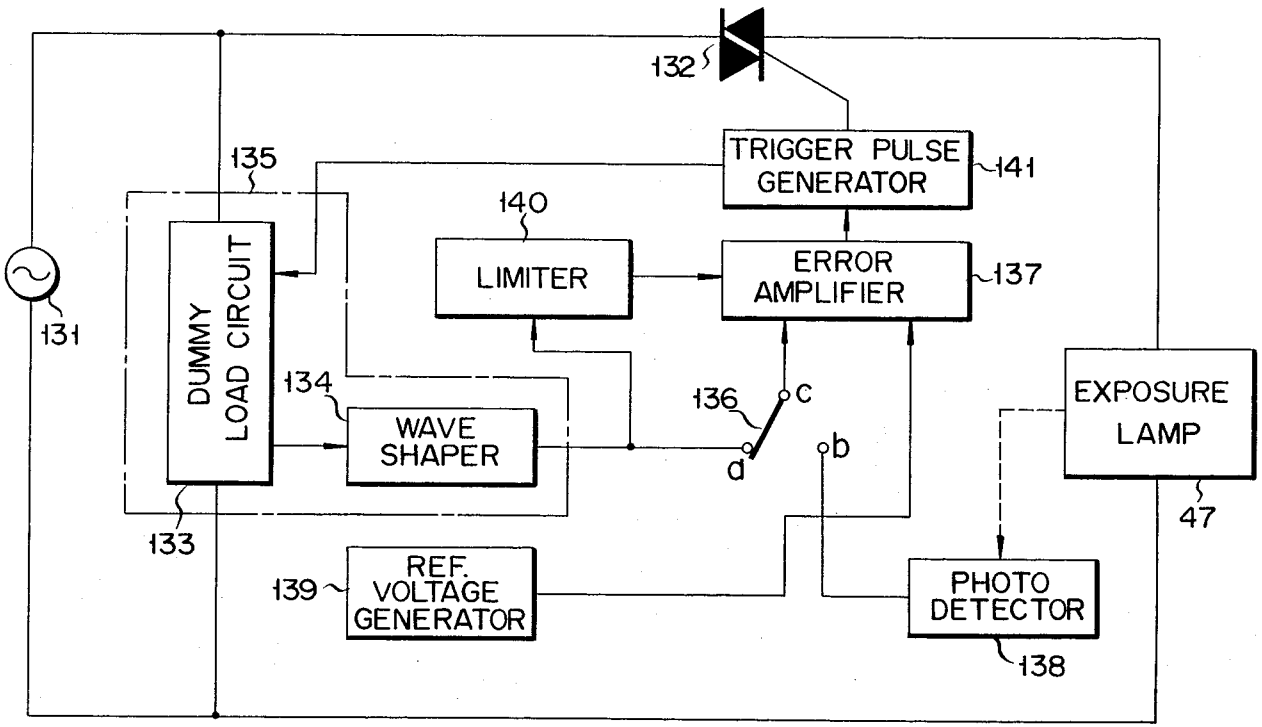
FIG. 30 is a schematic block diagram of an exposure control unit of the present invention.

The control of the exposure will be described in detail with reference to FIG. 30. FIG. 30 shows the overall configuration of an exposure amount regulator 76. The exposure lamp 47 is connected to an AC power source 131 through a bidirectional thyristor 132. A dummy load circuit 133 is connected to the power source 131. When the thyristor 132 is ON, the dummy load circuit 133 applies, to a dummy load, a voltage corresponding to a voltage applied across the two ends of the exposure lamp 47. The dummy load circuit 133 produces an output corresponding to the voltage applied across the dummy load. The output voltage from the dummy load circuit 133 is supplied to a wave shaper 134. The wave shaper 134 shapes the output voltage wave from the dummy load circuit 133 and produces a voltage corresponding to an effective voltage of the exposure lamp 47. Thus, the dummy load circuit 133 and the wave shaper 134 constitute a voltage source circuit 135 which produces a voltage corresponding to a voltage applied across the exposure lamp 47. The output voltage from the wave shaper 134 is supplied to a comparator, for example, an error amplifier 137, through a contact a of a two-position switch 136 as the selector. The output voltage from a photodetector 138 is supplied to the error amplifier 137 through a contact b of the two-position switch 136. The error amplifier 137 compares the output voltage from the wave shaper 134 or the photodetector 138 with the reference voltage produced by a reference voltage generator 139. If an error occurs between the voltages, the error amplifier 137 produces a signal in accordance with the error. The photodetector 138 detects light reflected by the document and produces a voltage signal in accordance with the amount of measured light. A limiter 140 is connected to the error amplifier 137. When the output voltage from the wave shaper 134 exceeds a predetermined value, the limiter 140 limits the output from the error amplifier 137. Thus, a voltage which exceeds the rated voltage may not be applied across the exposure lamp 47. The output signal from the error amplifier 137 is supplied to a trigger pulse generator 141. The trigger pulse generator 141 produces a trigger pulse in synchronism with a frequency of the power source 131. The phase of the trigger pulse is controlled by the output signal of the error amplifier 137. The controlled trigger pulse is supplied to the gate of the thyristor 132.

The mode of operation of the circuit of the above arrangement will be described in detail in FIG. 30. Assume that the operator sets the two-position switch 136 to the contact a position, and that an error is present between the output voltage from the wave shaper 134 and the reference voltage from the reference voltage generator 139. The output voltage from the error amplifier 137 is increased or decreased in accordance with the error. The phase of the trigger pulse from the trigger pulse generator 141 is also changed. Therefore, the ON period of the thyristor 132 is changed, and the change is fed back to the error amplifier 137 by means of the trigger pulse applied across the dummy load circuit 133. Therefore, the output voltage from the wave shaper 134 is regulated to be equal to the reference voltage from the reference voltage regulator 139. In other words, the voltage applied across the exposure lamp 47 is kept constant. The limiter 140 detects the output voltage from the wave shaper 134. The limiter 140 limits the output from the error amplifier 137 only when the output voltage from the wave shaper 134 is detected by the limiter 140 to exceed the predetermined value. Assume now that the operator sets the two-position switch 136 to the contact b position. Light from the exposure lamp 147 is reflected by the document and is incident on the photodetector 138. The photodetector 138 then produces a voltage in accordance with the amount of light incident thereon. The output voltage is supplied to the error amplifier 137. Assume that a low output voltage from the photodetector 138 corresponds to a small amount of light, and that a small amount of light reflected by the document is incident on the photodetector 138. When the background of the content of the document is dark, a small amount of light reflected by the document is incident on the photodetector 138. If the reference voltage from the reference voltage generator 139 is low, the error amplifier 138 amplifies the difference between the output voltage from the photodetector 138 and the reference voltage and supplies an error voltage to the trigger pulse generator 141. The trigger pulse generator 141 causes the thyristor 132 to increase its ON period. Thus, the amount of light emitted from the exposure lamp 47 is increased. The amount of light from the exposure lamp 47 is detected again in the photodetector 138. The output voltage from the photodetector 138 is compared again with the reference voltage. In this manner, as a whole, the amount of light reflected by the document is kept constant. As a result, the optimal exposure can be obtained regardless of the density of the document. Furthermore, since the light reflected by the document is also detected, the variation of the power source voltage can also be compensated for.

Figure 31:
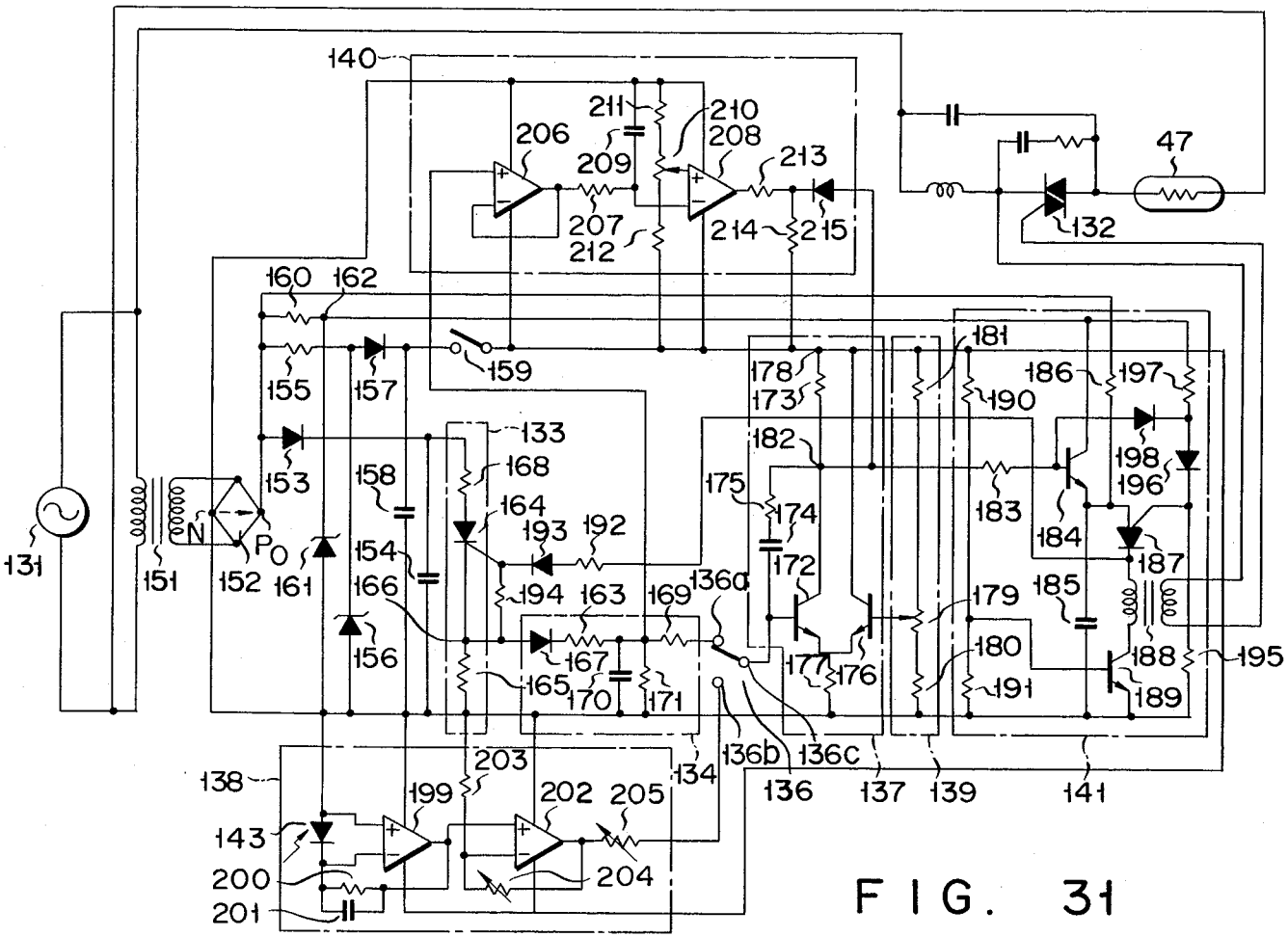
FIG. 31 is a detailed circuit diagram of the exposure control unit shown in FIG. 30.

FIG. 31 is a detailed circuit diagram of the circuit shown in FIG. 30. The primary coil of a power source transformer 151 is connected to a power source 131. A full-wave rectifier 152 is connected to the secondary coil of the power source transformer 151. A series circuit of a diode 153 and a capacitor 154 is connected between DC output terminals P0 and N of the full-wave rectifier 152. A series circuit of a resistor 155 and a Zener diode 156 is also connected between the DC output terminals P0 and N. A series circuit of a diode 157 and a capacitor 158 is connected in parallel with the Zener diode 156. A node between the diode 157 and the capacitor 158 is connected to one end of a switch 159. A series circuit of a resistor 160 and a Zener diode 161 is also connected between the DC output terminals P0 and N. A rectangular wave voltage in synchronism with the power source 131 appears at a node 162 between the resistor 160 and the diode 161. A series circuit of a resistor 168 and a unidirectional thyristor 164 which constitute a dummy load circuit 133, and a resistor 165 which functions as a dummy load is connected parallel with the capacitor 154. The cathode of the thyristor 164 which is the output terminal of the dummy load circuit 133 is connected to the resistor 165, and a node 166 therebetween is connected to a first stationary contact **136*a* of a two-position switch 136 through a series circuit of a diode 167 and resistors 163 and 169. A capacitor 170 and a resistor 171 are connected in parallel to each other between the DC output terminal N and a node between the resistors 163 and 169. The diode 167, the resistors 163, 169 and 171, and the capacitor 170 constitute a wave shaper 134. A movable contact 136*c* of the two-position switch 136 is connected to the base of an npn transistor 172. The collector of the npn transistor 172 is connected to the other terminal of the switch 159 through a resistor 173. A series circuit of a capacitor 174 and a resistor 175 which prevents oscillation is connected between the base and collector of the npn transistor 172. The emitter of the npn transistor 172 is connected to the emitter of an npn transistor 176, and the common node thereof is connected to the DC output terminal N through a resistor 177. The collector of the npn transistor 176 is connected to a node 178 between the switch 159 and the resistor 173, and the base of the npn transistor 176 is connected to a slider of a variable resistor 179. One end of the variable resistor 179 is connected to the DC output terminal N through a resistor 180, and the other end thereof is connected to the node 178 through a resistor 181. The npn transistors 172 and 176 constitute an error amplifier 137, and the variable resistor 179 and the resistors 180 and 181 constitute a reference voltage generator 139**.

A node 182 which functions as the output terminal of the error amplifier 137 between the collector of the npn transistor 172 and the resistor 173 is connected to the base of an npn transistor 184 through a resistor 183. The collector of the npn transistor 184 is connected to the node 162, and the emitter thereof is connected to the DC output terminal N through a capacitor 185 and to the DC output terminal P0 through a resistor 186. The emitter of the npn transistor 184 is also connected to the anode of a programmable unijunction transistor 187 (to be referred as a PUT 187 hereinafter). The cathode of the PUT 187 is connected to the DC output terminal N through a series circuit of the primary coil of a pulse transformer 188 and an npn transistor 189. The base of the npn transistor 189 is connected to the node 178 through a resistor 190 and to the DC output terminal N through a resistor 191. The cathode of the PUT 187 is connected to the gate of the thyristor 164 through a series circuit of a resistor 192 and a diode 193. The node between the diode 193 and the gate of the thyristor 164 is connected to the node 166 through a resistor 194. The secondary coil of the pulse transformer 188 is connected between the gate and the first anode of a thyristor 132. The gate of the PUT 187 is connected to the DC output terminal N through a resistor 195 and to the node 162 through a series circuit of a diode 196 and a resistor 197. The node between the diode 196 and the resistor 197 is connected to the base of the npn transistor 184 through a diode 198. The npn transistor 184, the capacitor 185, the PUT 187, the pulse transformer 188, the npn transistor 189 and the diodes 196 and 198 constitute a trigger pulse generator 141.

The anode of a photodiode 143 which constitutes a photocell or photodetector is connected to the DC output terminal N and to the non-inverted input terminal of an operational amplifier 199. The cathode of the diode 143 is connected to the inverted input terminal of the operational amplifier 199 and to the output terminal of the operational amplifier 199 through a parallel circuit of a feedback resistor 200 and a capacitor 201. The output terminal of the operational amplifier 199 is connected to the noninverted input terminal of an operational amplifier 202. The inverted input terminal of the operational amplifier 202 is connected to the DC output terminal N through a resistor 203 and to the output terminal of the operational amplifier 202 through a variable feedback resistor 204. The output terminal of the operational amplifier 202 is connected to a second stationary contact 136b of the two-position switch 136 through a variable resistor 205. The photodiode 143 and the operational amplifiers 199 and 202 constitute a photodetector 138.

The output terminal of the wave shaper 134, that is, the node between the resistors 163 and 169 is connected to the noninverted input terminal of an operational amplifier 206. The inverted input terminal of the operational amplifier 206 is connected to the output terminal thereof. The output terminal of the operational amplifier 206 is also connected to the noninverted input terminal of an operational amplifier 208 through a resistor 207, and the node thereof is connected to the DC output terminal N through a smoothing capacitor 209. The noninverted input terminal of the operational amplifier 208 is connected to the slider of a variable resistor 210 which sets the reference voltage. One end of the variable resistor 210 is connected to the DC output terminal N through a resistor 211, and the other end thereof is connected to the node 178 through a resistor 212. The output terminal of the operational amplifier 208 is connected to the node 178 through a series circuit of resistors 213 and 214. The node between the resistors 213 and 214 is connected to the node 182 through a diode 215. The operational amplifiers 206 and 208, the variable resistor 210 and the diode 215 constitute a limiter 140.

The mode of operation of the circuit shown in FIG. 31 will be described. Assume that the movable contact 136*c* of the two-position switch 136 is set to the first stationary contact 136*a*. In this case, the photodetector 138 is operated independently of the control of the exposure lamp. When the switch 159 is turned on, a voltage at the node 178 is divided by the resistors 190 and 191. A divided voltage is then applied to the npn transistor 189 which is then ON. A voltage at the node 178 is divided by the resistors 173 and 183. A divided voltage is applied to the base of the npn transistor 184 which is then ON. The capacitor 185 is charged by the npn transistor 184. When the anode voltage of the PUT 187 exceeds its gate voltage, the PUT 187 is ON. Thus, a pulse current flows through the primary coil of the pulse transformer 188. A pulse is generated at the secondary coil of the pulse transformer 188 and is defined as a trigger pulse which is then supplied to the gate of the thyristor 132. Thus, the thyristor 132 is ON to cause the exposure lamp 47 to light up. At the same time, the trigger pulse is applied to the gate of the unidirectional thyristor 164 through the resistor 192 and the diode 193, so that the unidirectional thyristor 164 is ON. Therefore, a voltage corresponding to that applied across the exposure lamp 47 is induced across the resistor 165. The voltage is thus rectified by the wave shaper 134 which comprises the diode 167, the resistors 163, 169 and 171, and the capacitor 170 and is regulated to correspond to the effective voltage of the exposure lamp 47. This voltage is applied to the base of the transistor 172 through the contacts 136*a* and 136*c* of the two-position switch 136. At this time, if the base voltage of the npn transistor 176 is higher than that of the npn transistor 172, the collector voltage of the npn transistor 172 is increased, and hence the base voltage of the npn transistor 184 is increased. As a result, the charge timing of the capacitor 185 is speeded up. The PUT 187 generates a pulse at an early timing, so that the ON period of the thyristor 132 is increased. The voltage applied to the exposure lamp 47 is increased, thereby increasing the amount of light. The increased ON period of the thyristor 132 is fed back to the thyristor 164. The base voltage of the npn transistor 172 is increased and reaches the base voltage of the npn transistor 176. Thus, the base voltages of the npn transistors 172 and 176 are balanced. Since the base voltage of the npn transistor 176 is kept constant independently of a variation in the voltage of the power source 131, the base voltage of the npn transistor 172 is kept constant. In other words, the voltage applied across the exposure lamp 47 is kept constant. Note that the base voltage (reference voltage) of the npn transistor 176 is changed by the variable resistor 179 to change the voltage applied across the exposure lamp 47.

Assume that the movable contact 136*c* of the two-position switch 136 is set to the second stationary contact 136*b*. Light from the exposure lamp 47 is reflected by the document and is guided to the photosensitive drum. However, some of the light rays are incident on the light-receiving plane of the light scattering member and are reflected thereby. Most of the reflected light rays are incident on the photodiode 143. The photocurrent produced by the photodiode 143 is converted to a voltage by the operational amplifier 199 and the feedback resistor 200. The voltage is then amplified by the operational amplifier 202. The output voltage from the operational amplifier 202 is applied to the base of the npn transistor 172 through the contacts 136*b* and 136*c* of the two-position switch 136. When the background of the contents of the document is dark, the amount of light reflected by the document is small, and a current produced by the photodiode 143 is small. Thus, a low voltage is applied to the base of the npn transistor 172. At this time, if the base voltage of the npn transistor 176 is higher than that of the npn transistor 172, the voltage applied across the exposure lamp 47 is increased, so that the amount of light emitted from the exposure lamp 47 is increased. Upon an increase in the amount of light emitted, the amount of light reflected by the document is increased, and the output voltage from the photodetector 138 is increased so as to equalize the base voltages of the npn transistors 172 and 176. As a result, the amount of light emitted from the exposure lamp 47 is automatically changed in accordance with the density of the document so as to keep the amount of light incident on the photosensitive drum constant. An optimal exposure or exposure amount can be provided in accordance with various conditions of the documents, thus obtaining the optimal copy. Furthermore, since a change in the amount of light emitted from the exposure lamp 47 due to the variation of the power source voltage can be controlled, stable operation is obtained regardless of the variation of the power source voltage.

The mode of operation of a controller 140 is as follows. The voltage corresponding to the voltage applied across the exposure lamp 47 is obtained at the node between the resistors 163 and 169 and is applied to the operational amplifier 206 as a voltage follower. The output from the operational amplifier 206 is smoothed and supplied to the operational amplifier 208 as a comparator. When the voltage applied to the exposure lamp 47 is increased, the input voltage of the operational amplifier 206 is increased, and the input voltage to the inverted input terminal of the operational amplifier 208 is increased. When the voltage to the inverted input terminal exceeds the reference voltage set by the variable resistor 210 and the resistors 211 and 212, the operational amplifier 208 is ON. Thus, a voltage applied to the cathode of the diode 215 becomes a value such that the voltage at the node 178 is divided by the resistors 213 and 214. If the divided voltage is lower than the forward-bias voltage drop across the voltage at the node 182, the voltage at the node 182, that is, the output voltage from the error amplifier 137 is limited. Thus, the voltage applied to the exposure lamp 47 is limited to be below a predetermined voltage.

The limiter 140 is required for the following reason. Generally, when an exposure lamp is used which has a voltage as its rated voltage of less than the commercial AC voltage, a voltage applied across the exposure lamp must be controlled not to exceed the rated voltage. Thus, the limiter 140 is required. Assume that a black document is placed on the document table or that no document is placed on it without covering the table with the document cover when the movable contact 136*c* of the two-position switch 136 is set to the second stationary contact 136*b*. The output voltage of the photodetector 138 becomes minimum (substantially zero), so that the limiter 140 is required for the exposure lamp described above. Immediately after the lamp goes on, the amount of light from the exposure lamp 47 is small, and the output voltage from the photodetector 138 is small. Thus, the limiter 140 is required.

Figure 32:
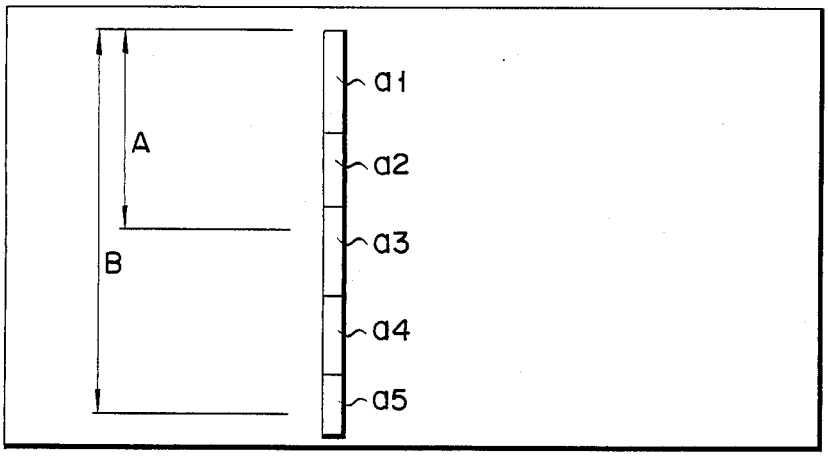
FIGS. 32 to 34 are views for explaining the principle of another embodiment of the present invention.
Figure 33:
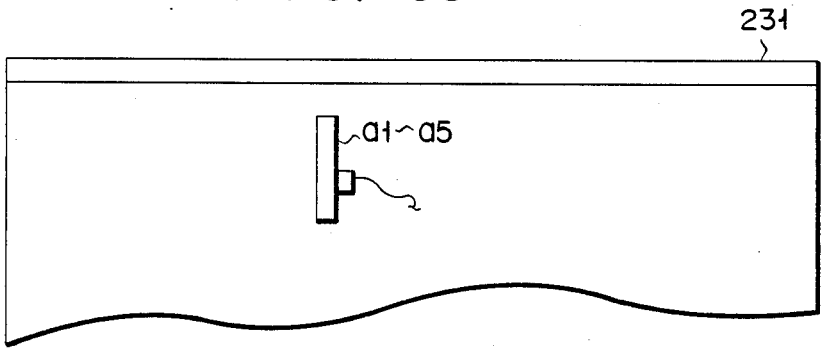
Figure 34:
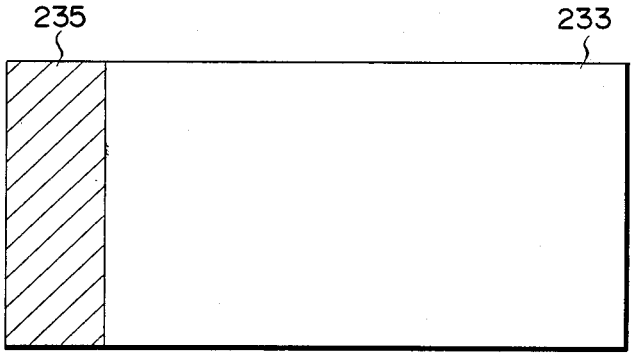

FIGS. 32 to 34 show an embodiment in which a plurality of focusing units described in the application examples and modifications described above are used and light-receiving elements are mounted on the focusing units to detect the image density of the document at an optimal width with respect to the width of the image of the document.

FIGS. 6, 12, 14, and 15 show the mounting positions of the focusing units. These mounting positions are applied to the configuration in FIG. 32, in which a plurality of focusing units are aligned to automatically change the light-receiving width.

Referring to FIG. 32, reference symbols a1 to a5 respectively denote light-receiving widths of the focusing units viewed from a document side to be copied.

Figure 35A:
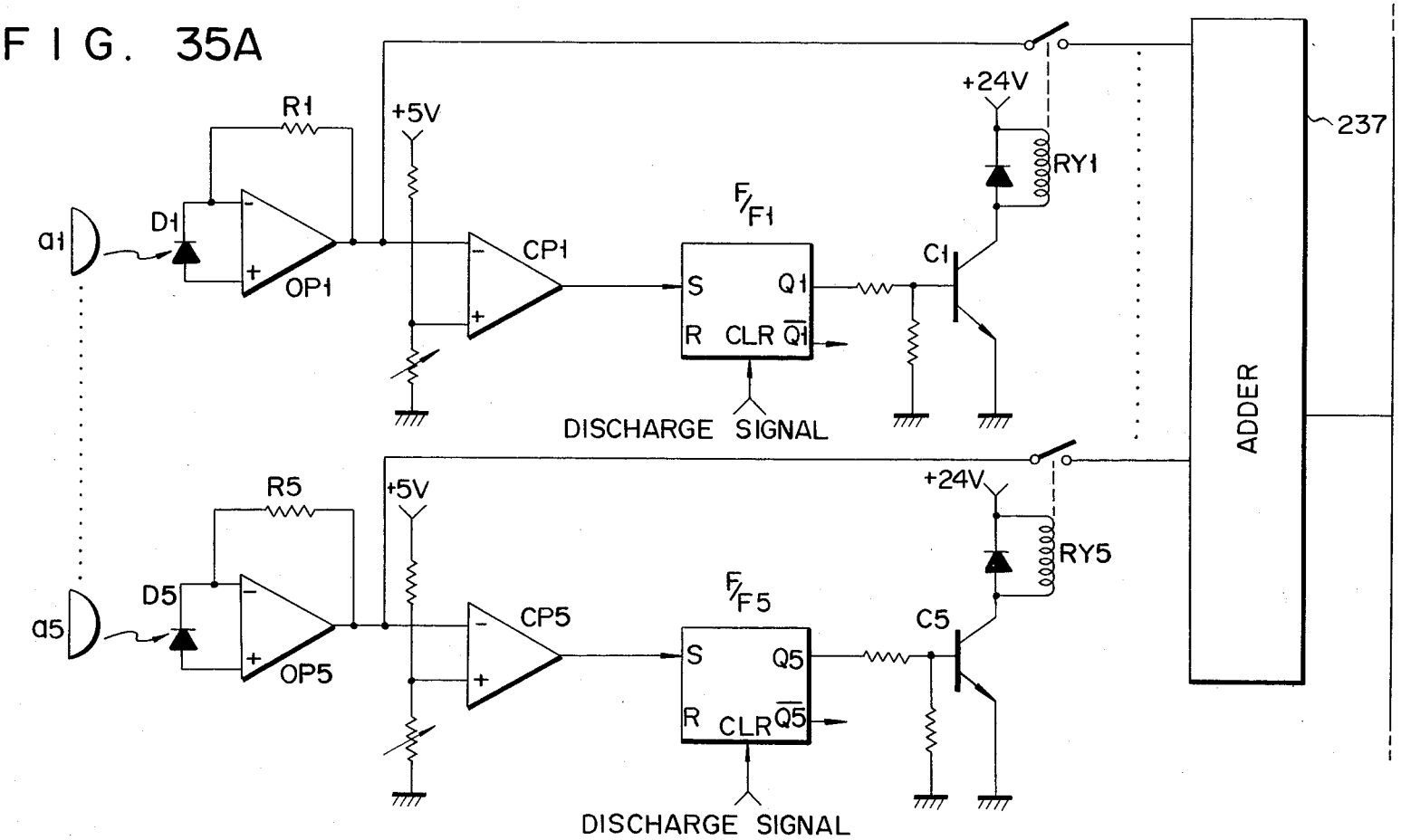
FIGS. 35A and 35B are schematic and block diagrams respectively showing the circuit according to the embodiment shown in FIGS. 32 to 34.
Figure 35B:
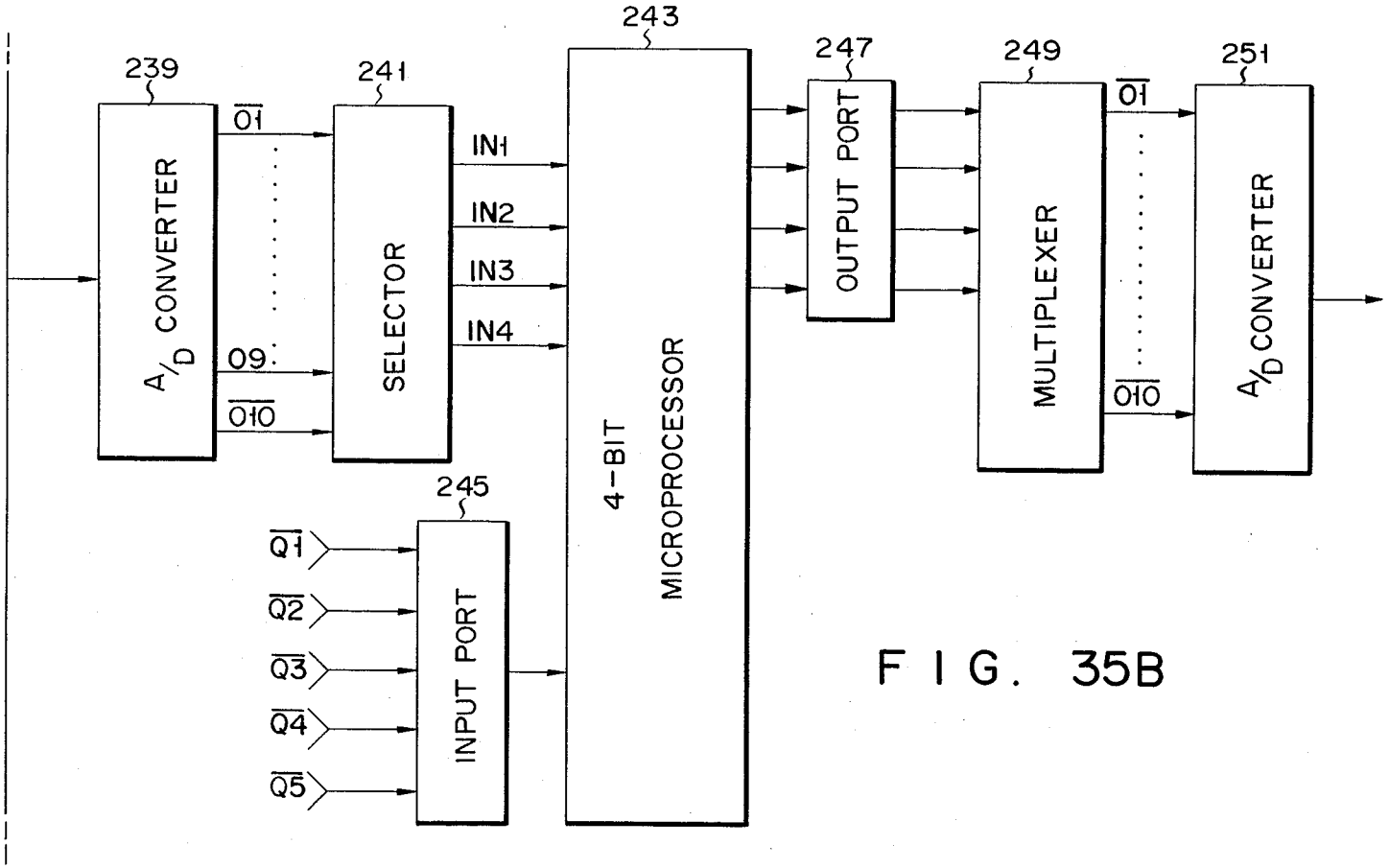

Referring to FIG. 34, the optimal width is determined by detecting a color stripe 235 of black or any other color which is coated on the exposure start side of an exposure surface 233 of the document cover. In this case, a photocurrent obtained by detecting the color stripe 235 is smaller than the photocurrent obtained by detecting the document. The light rays converged to the light-receiving widths a1 to a5 of the focusing units are respectively detected as photocurrents by light-receiving elements or photodiodes D1 to D5 (see FIG. 35A). The photocurrents from the photodiodes D1 to D5 are respectively converted to photovoltages by resistors R1 to R5 and operational amplifiers OP1 to OP5. The voltages are compared with a reference voltage by respective comparators CP1 to CP5, respectively. If the output voltages from the operational amplifiers OP1 to OP5 exceed the predetermined threshold voltage, they are latched by flip-flops FF1 to FF5, respectively. Outputs from the flip-flops FF1 to FF5 are applied to relay excitation circuits C1 to C5, respectively, to cause relays RY1 to RY5, respectively, to operate, so that the outputs are supplied to an adder 237. The photovoltages are added by the adder 237, and the output therefrom is applied to an A/D converter 239 shown in FIG. 35B. An output from the A/D converter 239 is supplied to a 4-bit microprocessor 243 through a selector 241. In this case, the output from the A/D converter 239 is divided into three sets and is then fetched as 12-bit data in the microprocessor 243. Meanwhile, outputs from the inverted output terminals $\overline{Q}$ of the flip-flops FF1 to FF5 are supplied to the microprocessor 243 through an input port 245. In the microprocessor 243, the sum obtained by the adder 237 is divided by the inverted outputs from the flip-flops FF1 to FF5. In other words, the light-receiving widths are divided by a certain number of photodiodes in accordance with the size of the document, thus obtaining the mean value of the output from the adder 237. The mean value is supplied to a D/A converter 251 through an output port 247 and a multiplexer 249. The converted output from the D/A converter 251 is supplied to the noninverted input terminal of the operational amplifier 202 of the photodetector 138 shown in FIG. 31. Thus, the exposure lamp is controlled. In this case, the photodiode 143, the capacitor 201, the resistor 200 and the operational amplifier 199 need not be used.

Since the plurality of focusing units detect the document density and the document width, the optimal density in accordance with the width of the document can be provided. Furthermore, the size of the copying paper sheet of the copying machine or the like can be automatically selected, by the signal which detects the document width, that is, by determining which relays RY1 to RY5 are excited.

The above embodiment only exemplifies the present invention. Other members which have the same functions may replace the corresponding members of the present invention.

What is claimed is:

1. An image formation apparatus for forming an image by projecting an image of a document onto a surface of an image carrier, said apparatus including an image density detecting unit having detecting means for detecting an amount of light reflected by the document, characterized in that said detecting means comprises:

transparent light conducting medium means for conducting light, said medium means defining light incident plane means for receiving light reflected by said document;

first light reflecting plate means, optically coupled to said medium means, for receiving and reflecting light conducted by said medium means, said first plate means including a reflecting cross-section defining a substantially quadric surface which focuses incident light toward a focal point; and light detecting element means, optically coupled to said first plate means, for receiving light which has been incident on the whole light incident plane means and reflected and focused by the whole quadric surface onto said focal spot.

2. An apparatus according to claim 1, wherein said quadric surface comprises a parabolic surface.

3. An apparatus according to claim 1, wherein said quadric surface comprises an elliptical surface.

4. An apparatus according to claim 1, wherein said light detecting element means is embedded in said first reflecting plate means in a position corresponding to the focal point of said quadric surface.

5. An apparatus according to claim 1, wherein the reflecting plane of said first reflecting plate means is discontinuous.

6. An apparatus according to claim 2, wherein said medium means has refractive index of about 1.5, and which has a focal point P1 and a height y0 plotted in the X-Y coordinates, and a ratio of the focal point P1 to the height y0 is set in a range of 0.5 to 1.0.

7. An apparatus according to claim 1, wherein a light-receiving width of said medium means is equal to or smaller than a minimum document width for said image formation apparatus.

8. An apparatus according to claim 2, wherein a light-receiving width of said medium means is equal to or smaller than a minimum document width for said image formation apparatus.

9. An apparatus according to claim 3, wherein a light-receiving width of said medium means is equal to or smaller than a minimum document width for said image formation apparatus.

10. An apparatus according to claim 4, wherein a light-receiving width of said medium means is equal to or smaller than a minimum document width for said image formation apparatus.

11. An apparatus according to claim 5, wherein a light-receiving width of said medium means is equal to or smaller than a minimum document width for said image formation apparatus.

12. An apparatus according to claim 6, wherein a light-receiving width of said medium means is equal to or smaller than a minimum document width for said image formation apparatus.

13. An apparatus according to claim 7, further comprising means for automatically changing said light-receiving width by arranging a plurality of focusing units in accordance with a document width.

14. An apparatus according to claim 13, wherein said document width is detected by said plurality of focusing units to select a proper number of said plurality of focusing units in accordance with said document width, thereby detecting an image density by means of said light-detecting element means to obtain an optimal image.

15. An apparatus according to claim 1, further comprising second light reflecting plate means, disposed at the focal point of said first light reflecting plate means, for reflecting light reflected by said first light reflecting plate means toward said element means.

16. An apparatus according to claim 15, wherein said first and second light reflecting plate means are disposed inside of said medium means.

17. An apparatus according to claim 15, wherein said first and second light reflecting plate means are disposed on an outer wall of said medium means.

18. An apparatus according to claim 1, wherein a mask is formed on said light incident plane means.

19. An apparatus according to claim 1, wherein slits are formed in said light incident plane means.

20. An apparatus according to claim 1, wherein said quadric surface has a focal point onto which light incident on said light incident plane is converged.

21. An apparatus for copying a document onto a medium, comprising:

light source means for directing light toward a document to be copied;

rotating drum means for storing an image of said document in response to the projection of said image onto said drum means;

developing means for transferring said stored image from said drum means to a medium, including means for controlling the density of said transferred image in response to a density control signal;

first optical means for receiving a first portion of the light produced by said light source means and reflected by said document and projecting the resulting image of said document onto said drum means to form said stored image;

second optical means for receiving a second portion of the light produced by said light source means and reflected by said document and for focusing said received second portion at a focal point; and light detecting means, optically coupled to said focal point, for producing said density control signal in response to the intensity of said focused light, wherein said second optical means includes:

light transmission body means for receiving light reflected by substantially the entire width of said document, said body means including means for defining a curved surface toward which said received light is directed;

first reflecting means, disposed on said curved surface, for focusing said received light at a point within said body means; and means for coupling said light focused at said point to said light detecting means.

22. An apparatus as in claim 21 wherein said focused light coupling means comprises a conical reflector disposed within said body means at said point.

23. An apparatus as in claim 21 wherein said body means defines at least three substantially planar surfaces.

24. An apparatus for copying a document onto a medium, comprising:

light source means for directing light toward a document to be copied;

rotating drum means for storing an image of said document in response to the projection of said image onto said drum means;

developing means for transferring said stored image from said drum means to the medium, including means for controlling the density of said transferred image in response to a density control signal;

first optical means for receiving a first portion of the light produced by said light source means and reflected by said document and for projecting the resulting image of said document onto said drum means to form said stored image;

second optical means comprised of a transparent optical medium and including a light reflecting plate having a light incident plane and a light reflective surface, the cross-section of the light reflective surface being substantially quadric in configuration and said light reflective surface being uninterruptedly formed with respect to the light incident plane to permit light which is incident thereon to be directed onto a focal point; and light detecting means, optically coupled to said focal point, for producing said density control signal in response to the intensity of said focused light.

25. An apparatus for focusing light comprising:

light transmissive solid body means for receiving light, said body means including means for defining a planar surface and means for defining a quadric surface, light incident upon said planar surface being transmitted through said body means toward said quadric surface;

first reflecting means, disposed on said quadric surface, for focusing said light incident on said quadric surface toward a focal point within said body means; and light detecting means, at least partially embedded within said body means at said focal point, for detecting the intensity of light focused toward said point.

* * * * *